US005652971A

United States Patent [19]

Wokas

[11] Patent Number: 5,652,971

[45] Date of Patent: Aug. 5, 1997

[54] BIDET ATTACHMENT FOR TOILETS

[76] Inventor: Albert L. Wokas, 5815 Dew Ct., Rocklin, Calif. 95677

[21] Appl. No.: 500,154

[22] Filed: Jul. 10, 1995

Related U.S. Application Data

[63] Continuation-in-part of Ser. No. 261,012, Jun. 14, 1994, abandoned.

[51] Int. Cl.[6] ..... E03D 9/08

[52] U.S. Cl. ..... 4/420.4

[58] Field of Search ..... 4/420.2, 420.4, 4/420.5, 447, 448, 567

[56] References Cited

U.S. PATENT DOCUMENTS

| | | | |
|---|---|---|---|
| 1,193,302 | 8/1916 | Seltner | 4/567 |
| 2,957,180 | 10/1960 | McMullen . | |
| 3,425,066 | 2/1969 | Berger . | |
| 4,181,985 | 1/1980 | Rius | 4/420.4 X |
| 5,138,726 | 8/1992 | Campbell . | |
| 5,263,205 | 11/1993 | Le Unissen . | |

FOREIGN PATENT DOCUMENTS

| | | | |
|---|---|---|---|
| 3209383 | 9/1983 | Germany | 4/420.4 |

*Primary Examiner*—Charles E. Phillips
*Attorney, Agent, or Firm*—Laubscher & Laubscher

[57] ABSTRACT

A bidet attachment which can be retrofit to any conventionally sized toilet includes fittings for rigidly connecting the attachment to the existing water supply line and toilet water tank, a valve for selectively controlling water flow through the device, a hand-adjustable supply conduit extending between the seat and the toilet bowl having a remote end portion extending downwardly below a rear center portion of the seat into the toilet bowl, and an adjustable nozzle directed upwardly generally normal to the remote end portion, whereby water sprayed from the nozzle is directed on the rectal area of a user. The adjustable supply conduit includes a plurality of tube segments which are slidably connected with a plurality of corresponding elbow fittings.

1 Claim, 4 Drawing Sheets

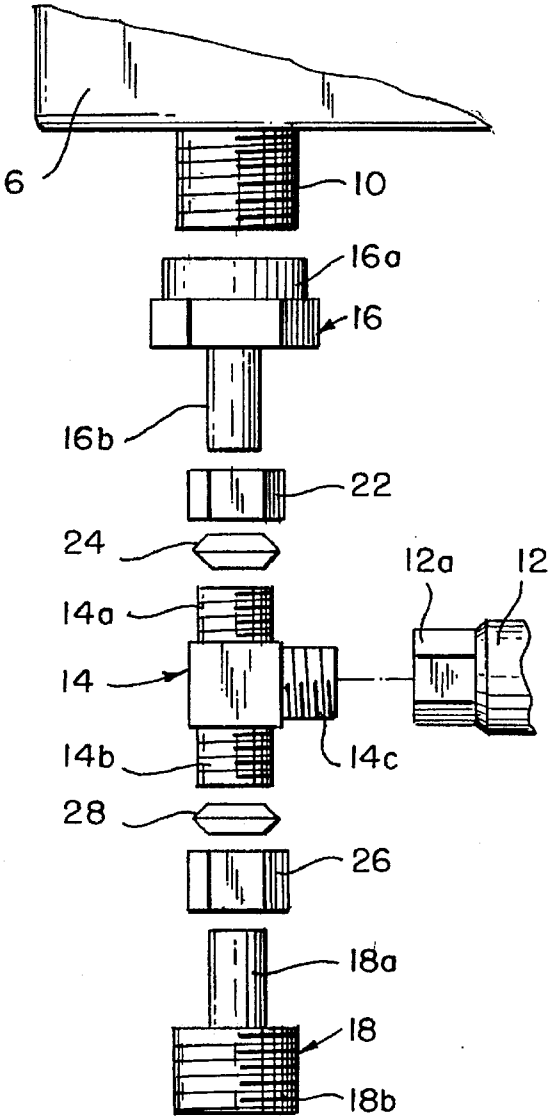
FIG. 3
FIG. 1
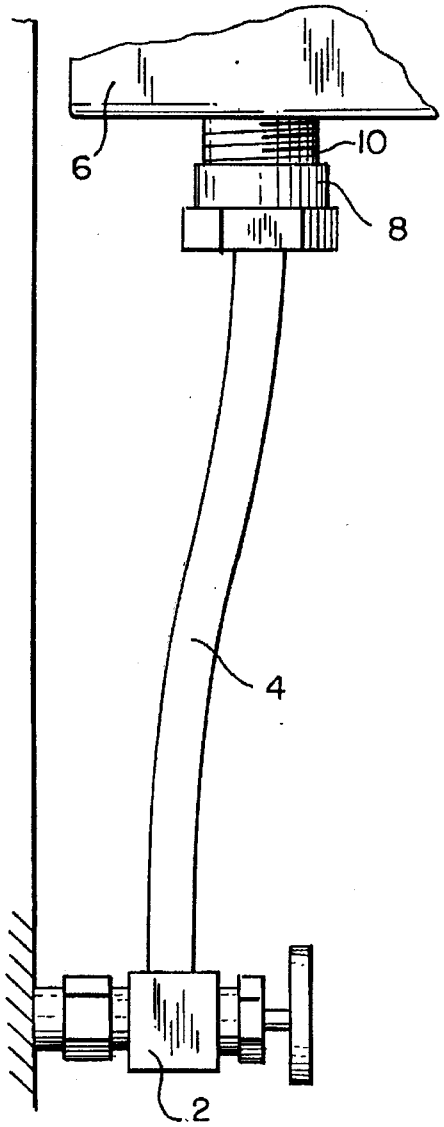

BIDET ATTACHMENT FOR TOILETS

This application is a continuation in part of Ser. No. 08/261,012 filed Jun. 14, 1994 now abandoned.

STATEMENT OF THE INVENTION

The present invention relates to a pre-assembled bidet accessory which can be retrofit to an existing toilet and, in particular, to a pre-assembled bidet including fittings for connecting the accessory between the existing water supply line and toilet water tank, a valve for selectively controlling water flow, an adjustable supply conduit extending between the toilet seat and the toilet rim including a remote end portion directed downwardly into the toilet bowl below a rear portion of the seat, and an adjustable nozzle directed upwardly generally normal to the remote end portion of the conduit whereby water sprayed from the nozzle is directed on the rectal area of a user.

The accessory allows a user to have a bowel movement, activate the valve to spray a column of water on the rectal area thereby cleansing the area, and then dry the area with a normal amount of toilet paper. If a more thorough cleansing of the crotch area is desired, the user may straddle the toilet in a bidet like manner (with the seat up or down) and wash the crotch in the direct nozzle water stream.

BRIEF DESCRIPTION OF THE PRIOR ART

Bidet accessories which attach to a toilet are known in the patented prior art. Such devices are shown in, for example, the U.S. Pat. Nos. to McMullen No. 2,957,180, Berger No. 3,425,066, Campbell No. 5,138,726, and Leunissen No. 5,263,205. These prior devices, however, often require a mounting plate or mounting bar for installation or are mounted directly on the toilet seat and can only be used with the seat in the down position. In addition, bidet accessories which employ movable hoses which are attached to bathroom sinks are known. However, such devices must be removed after use. Other devices such as the Swiss and Japanese "Shower Toilets " require the replacement or partial replacement of the existing toilet.

The present invention was developed to overcome these and other drawbacks of the prior devices by providing an improved bidet accessory which can be permanently installed quickly and easily on an existing toilet.

SUMMARY OF THE INVENTION

Accordingly, it is a primary object of the present invention to provide a pre-assembled bidet accessory which can be retrofit to any conventionally sized toilet. The accessory includes fittings for rigidly connecting the accessory between the existing water supply line and the toilet water tank, a valve for selectively controlling water flow through the accessory, an adjustable supply conduit extending between the seat and the toilet having a remote end portion extending downwardly below a rear center portion of the seat into the toilet bowl, and an adjustable nozzle directed upwardly generally normal to the remote end portion, whereby water sprayed from the nozzle is directed on the rectal area of a user.

It is a further object of the present invention to provide a pre-assembled bidet accessory which is easily and quickly installed without discarding any components of the original water supply line installation.

It is another object of the present invention to provide a pre-assembled bidet accessory having an adjustable supply conduit, whereby the angle and length of the conduit can be adjusted by hand.

BRIEF DESCRIPTION OF THE DRAWINGS

FIG. 1 is a view of a typical toilet water supply line installation;

FIG. 3 is an exploded view of the fittings for connecting the control valve to the toilet water tank and supply line;

DETAILED DESCRIPTION

Figure 2:
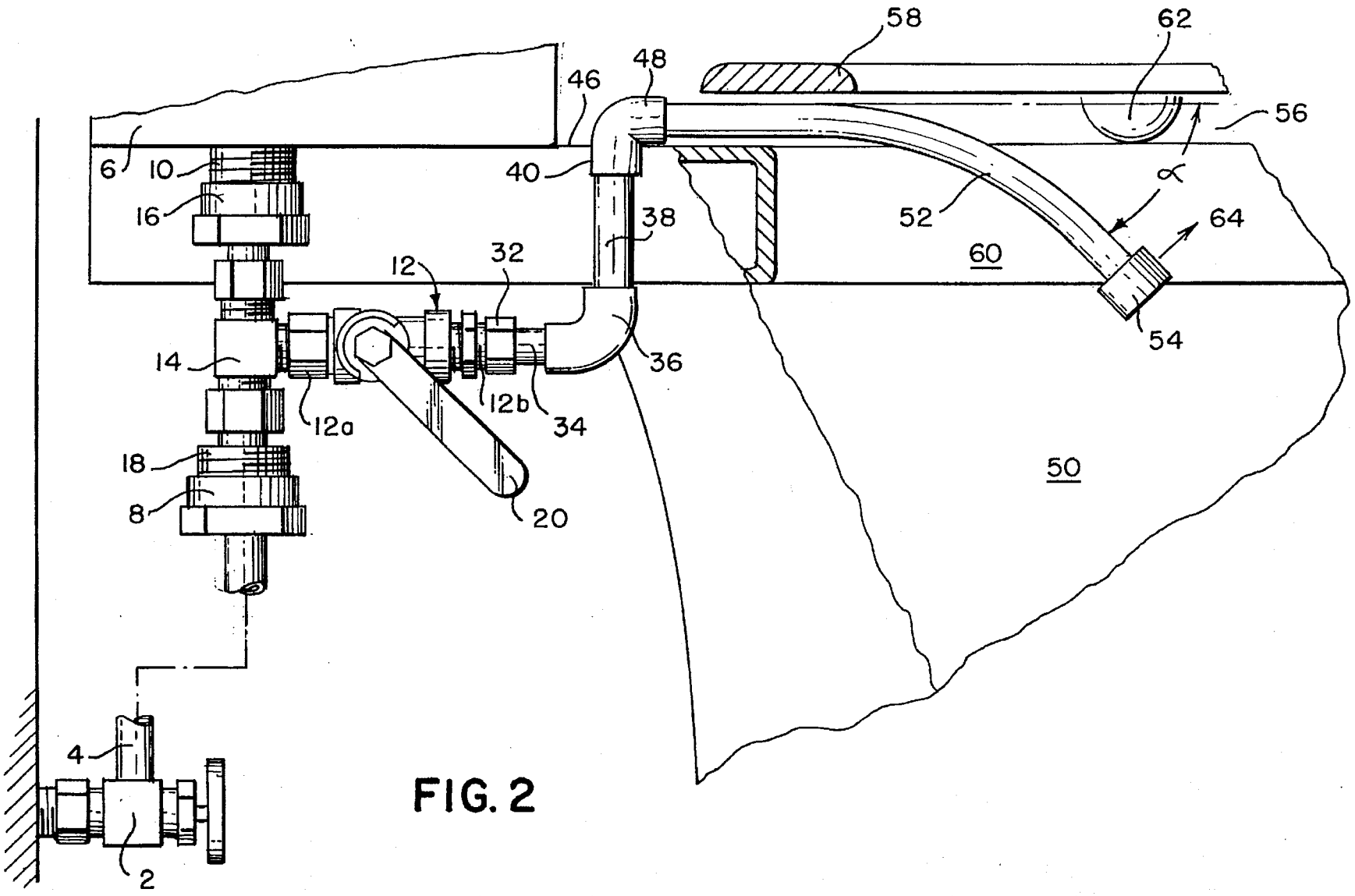
FIG. 2 is a partially sectioned side view showing the present invention retrofit to the toilet installation of FIG. 1.

Referring first to FIG. 1, there is shown a typical water supply line connection of a toilet. A shut-off valve 2 allows water to flow from a source (not shown), through a supply line 4 to the toilet water tank 6. The supply line is typically a flexible braided-type hose and includes a female ball cock nut fitting 8 on its upper end. The water tank 6 includes a downwardly extending male threaded ball cock pipe stub 10 which mates with the female ball cock fitting 8 to form a watertight connection.

FIG. 2 shows the present invention retrofit to the toilet installation of FIG. 1. The accessory includes a control valve 12 connected to the pipe stub 10 and supply line 4 via tee 14 and fittings 16 and 18 which are shown in greater detail in FIG. 3. The valve is any conventional valve such as a ball valve, gate valve, or needle valve which includes a handle 20 which can be manually alternated between an open position allowing water to flow therethrough and a closed position preventing flow.

Figure 4:
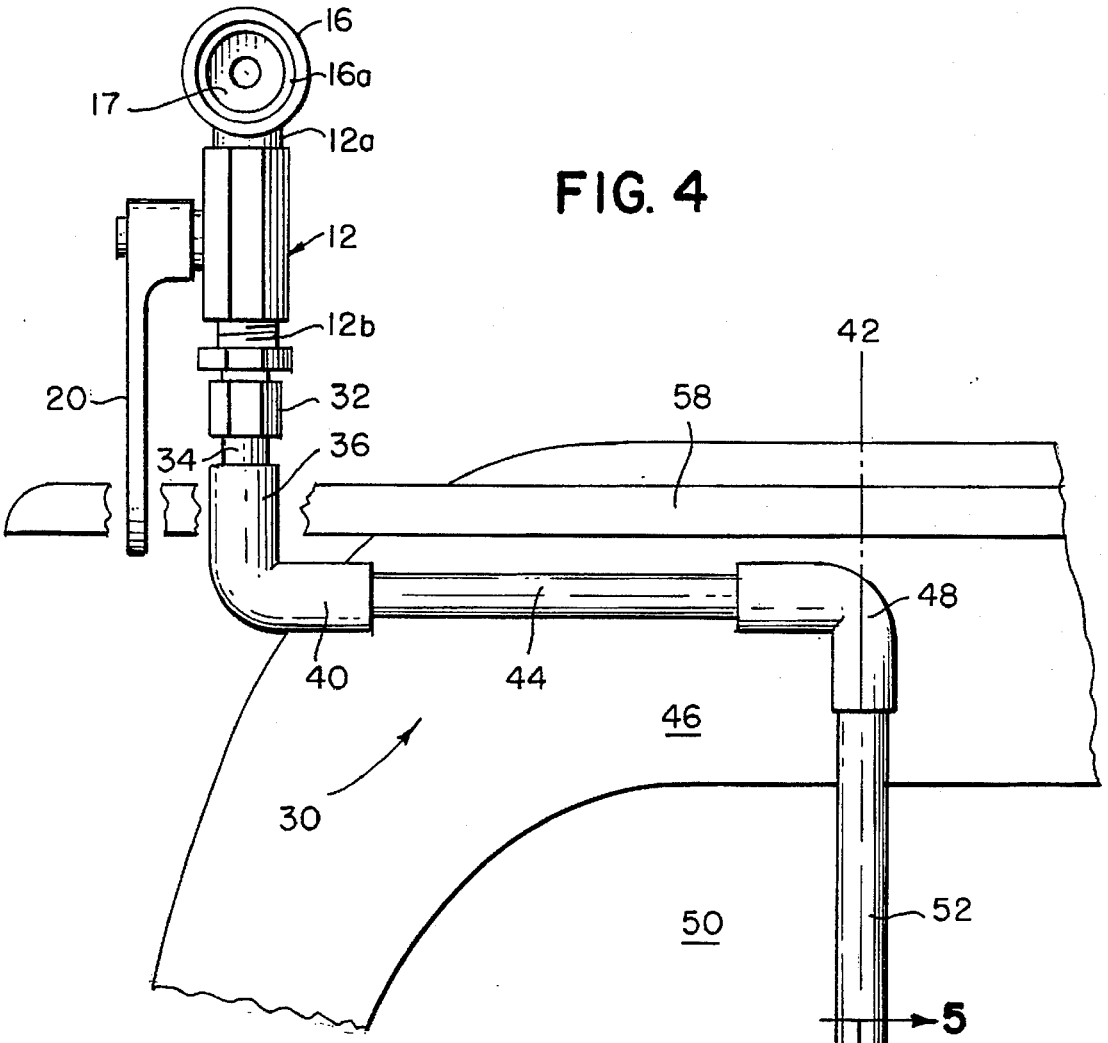
FIG. 4 is a top view of the present invention with the toilet seat in the up position.

Fitting 16 is a female threaded ball cock nut similar to the female ball cock nut 8 and is adapted to connect with the male pipe stub 10. A flat washer-type gasket 17 (FIG. 4) seats down in the nut portion **16*a* of fitting 16 so that when the fitting is tightened, a watertight connection between it and pipe stub 10 is formed. Ball cock nut 16 includes a stub tube portion 16*b* at its lower end which is modified to extend into the upper leg 14*a* of tee 14. In this manner, as compression nut 22 is tightened, gasket 24 is compressed, thereby forming a watertight seal around stub portion 16*b***.

Fitting 18, a male threaded ball cock adapter, also includes a stub tube portion **18*a* which is inserted into the lower leg 14*b* of the tee and which is provided with a water tight seal via compression nut 26 and gasket 28. The male threaded portion 18*b* of fitting 18 is adapted to mate with the female ball cock nut 8 of the supply line which was originally connected with the toilet tank via pipe stub 10. In this manner, installation of the accessory is quick, simple, and utilizes all of the components of the original supply line assembly. It will be recognized, however, that if the supply line 4** includes a rigid pipe rather than a flexible hose, the pipe must be cut to the appropriate length or be replaced with a suitable flexible hose.

The inlet end 12*a* of the control valve is connected with a third leg 14*c* of the tee. A conduit 30 is connected with the outlet end 12*b* of the valve which includes a compression nut 32 which tightens to form a watertight seal around the first tube segment 34 of the conduit. The first tube segment connects with a first elbow 36 which is angled upwardly and receives a second tube segment 38. The second tube segment extends upwardly to a second elbow 40 which is angled in the direction of the center line 42 of the toilet. A third tube segment 44 extends toward the center of the toilet and connects with a third elbow 48. Elbows 40 and 48 engage the top surface of the toilet 46 and are supported thereon. The third elbow is angled toward the toilet bowl 50 and is connected with the nozzle assembly which includes an angled tube 52 and a nozzle 54. The angled tube 52 passes through a slot 56 between the upper surface 46 of the toilet rim 60 and the toilet seat 58 which is prevented from resting on the tube 52 due to brace member 62. Angled tube 52 extends downwardly into the bowl at an angle $\alpha$ of generally 45° and the nozzle 54 is directed upwardly generally normal to angled tube 52 to spray water as indicated by arrow 64.

Figure 6:
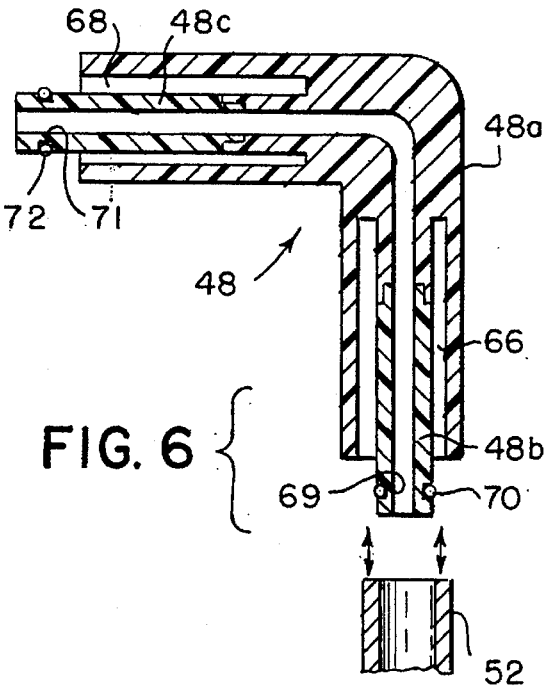
FIG. 6 is a detailed sectional view of an elbow.
Figure 5:
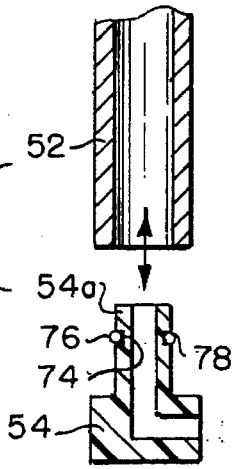
FIG. 5 is a sectional view taken along line 5—5 of FIG. 4.

A significant feature of the conduit 30 is that it can be adjusted by hand to fit any conventionally sized toilet. This in accomplished using slip elbows which slidably receive the tube segments. The structure and operation of the elbows are described referring to elbow 48 shown in FIG. 6, but it will be understood that elbows 36 and 40 are structurally and operationally similar. Elbow 48 includes a body portion 48*a* containing annular slots 66 and 68 adapted to receive the corresponding ends of tube segments 52 and 44, respectively. The slots define inner conduit portions 48*b* and 48*c* which include O-ring grooves 69 and 71, respectively. O-rings 70 and 72 seated in grooves 69 and 71, respectively, form watertight seals between tube segments 52 and 44 and inner conduit portions 48*b* and 48*c*, respectively, and also allow the elbow and tube segments to be moved relative to each other. By sliding the tube segments along the longitudinal axis of the slots, the overall length of the conduit can be varied, and by rotating the tube segments within the slots, the angle of the conduit can be adjusted. To facilitate movement of the tube segments in the slots, a lubricant such as grease or oil can be applied to the inner and/or outer surfaces of the tube segments.

The tube segments are formed of a rigid material such as copper or stainless steel and the elbows are formed of a synthetic plastic material such as Teflon, polypropylene, or nylon.

The nozzle is also provided with a rotatably adjustable connection. Stub portion 54*a* includes an O-ring groove 74 adapted to receive an O-ring 76. Thus, when the stub portion is inserted into the pipe segment 52, a watertight seal is formed and the nozzle can be rotated to control the direction of water spraying from the discharge port 78.

INSTALLATION AND OPERATION

Figure 8:
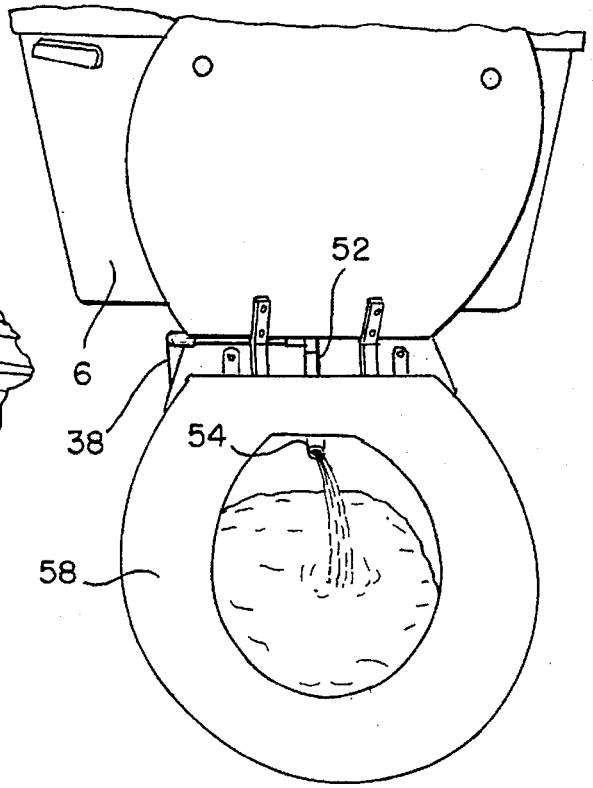
FIG. 8 shows the accessory with the toilet seat in the down position.
Figure 9:
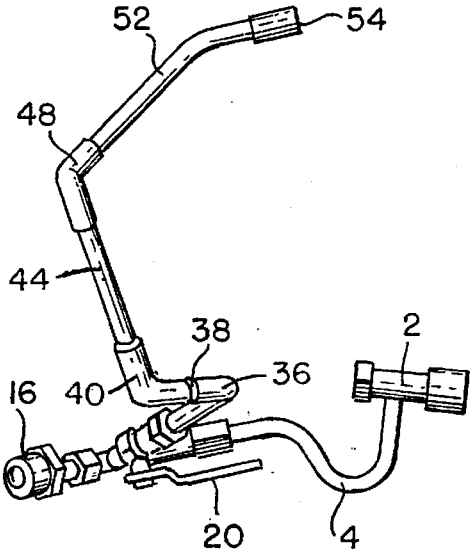
FIG. 9 is a perspective view of the invention.
Figure 10:
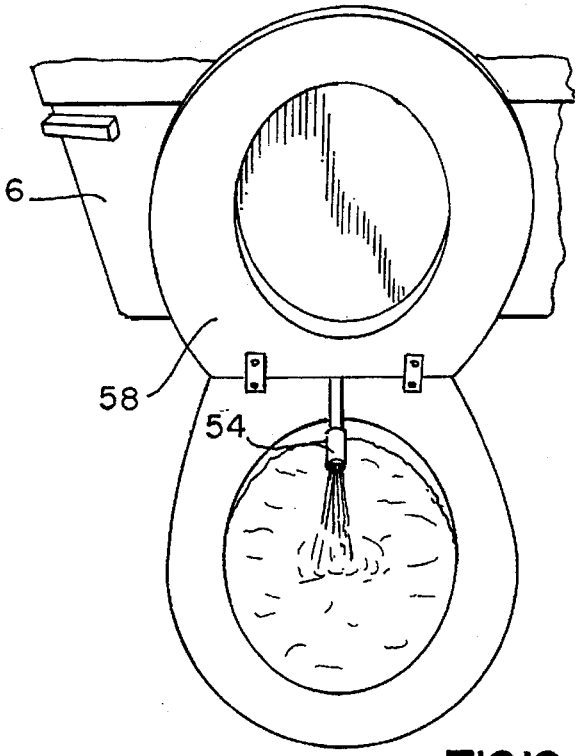
FIG. 10 shows the accessory with the toilet seat in the up position.

To install the pre-assembled bidet accessory, the water is shut off by closing valve 2. Since the accessory is pre-assembled, installation is accomplished by simply disconnecting the female ball cock nut 8 from the pipe stub 10 on the tank 6, lowering the ball cock nut about three inches to allow ball cock nut 16 to be connected with the tank, and re-attaching female ball nut 8 to the ball cock adapter 18. Once this is completed, the fittings are tightened to ensure watertight connections and the conduit position (length and angle) are adjusted as necessary. No tools are required to install or adjust the position of the accessory but a wrench may be used to tighten the fittings if necessary to ensure a tight connection. Valve 2 is then re-opened and water flows to the tank through the upper leg 14*a* of the tee and to the valve 12 through leg 14*c* of the tee. When the valve 12 is opened, water flows through the conduit to the nozzle 54 where it sprays upwardly from the discharge port 78. As shown in FIGS. 8 and 10, the accessory operates in the same manner whether the toilet seat is in the up or down position.

Figure 7:
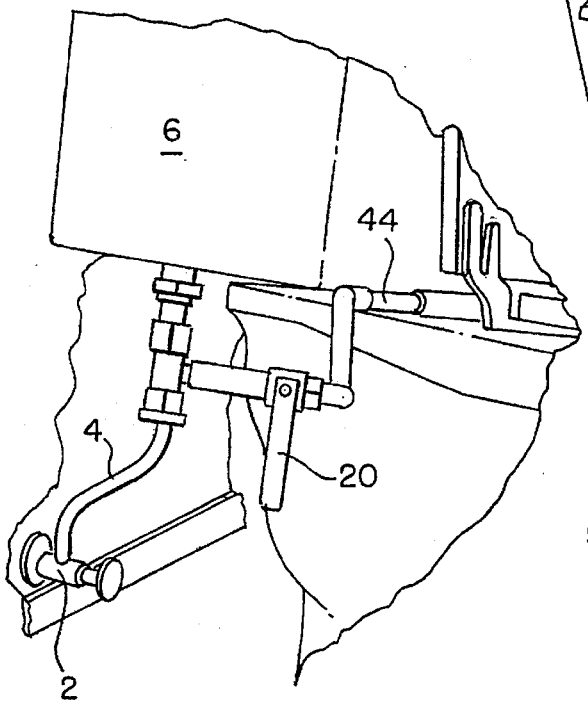
FIG. 7 is a perspective view of the invention showing an optional connection of the invention to the water supply line.

As shown in FIG. 7, if the fitting hose includes a fitting which is compatible with the lower leg 14*b* of the tee, the threaded ball cock adapter 18 and female ball cock nut 8 can be eliminated and the supply line connected directly to the tee.

While in accordance with the provisions of the Patent Statutes the preferred forms and embodiments of the invention have been illustrated and described, it will be apparent to those of ordinary skill in the art that various changes and modifications may be made without deviating from the inventive concept set forth above.

What is claimed is:

1. A hand-adjustable bidet attachment which can be retrofit to conventionally sized toilets having a water tank, a male threaded fitting mounted on the bottom of the water tank, a water supply line having a female threaded fitting adapted to mate with the male threaded fitting, a bowl, and a seat pivotally mounted on the bowl, the attachment comprising (a) a first adapter fitting having a male threaded portion rigidly connected with the water supply line female fitting and an oppositely extending stub portion;

(b) a second adapter fitting having a female threaded end portion rigidly connected with the male threaded fitting mounted on the bottom of the water tank and an oppositely extending stub portion;

(c) a T-shaped fitting having a first leg portion rigidly connected with said first adapter stub portion, a second leg portion arranged colinearly with said first leg portion rigidly connected with said second adapter stub portion, said first and second leg portions being arranged generally vertically relative to the toilet, and a third leg portion extending perpendicular to said first and second leg portions horizontally forwardly toward the toilet bowl;

(d) a control valve rigidly connected with said third leg portion and arranged colinearly therewith, said valve being hand-operable between opened and closed positions;

(e) a hand-adjustable rigid supply conduit having an adjustable configuration including (1) a first supply conduit tube segment arranged colinearly with said control valve having first and second end portions, said first end portion being rigidly connected with said control valve;

(2) a first 90 degree elbow fitting having a first end portion slidably connected with said first tube segment second end portion and a second end portion extending vertically upwardly toward the toilet seat;

(3) a second supply conduit tube segment arranged colinearly with said first elbow second end portion, said second tube segment having a first end portion slidably connected with said first elbow second end portion;

(4) a second 90 degree elbow fitting having a first end portion slidably connected with said second tube segment second end portion and a second end portion extending perpendicular to said first and second tube segments horizontally inwardly toward the toilet between the toilet bowl and toilet bowl seat;

(5) a third supply conduit tube segment having a first end portion slidably connected with said second elbow second end portion extending horizontally inwardly between the toilet bowl and toilet bowl seat;

(6) a third 90 degree elbow having a first end portion slidably connected with said third tube segment second end portion and a second end portion extending horizontal forwardly between the toilet bowl and toilet bowl seat;

(7) a fourth supply conduit tube segment having a first end portion slidably connected with said third elbow second end portion, said fourth tube segment having a remote end portion extending downwardly into the toilet bowl below a rear center portion of the seat at an angle less than 90 degrees;

(8) wherein each elbow comprises a body portion containing at each end an annular slot adapted to receive the corresponding end of a tube segment, said slot defines a protruding stem portion which carries an O-ring in an annular groove, said tube segment being inserted into said slot over said o-ring and stem portion thus forming a watertight seal while allowing rotational and longitudinal adjustment of said tube segment with respect to said elbow, and (f) a nozzle rotatably connected with said fourth tube segment remote end portion, said nozzle being directed upwardly generally normal to said fourth tube segment remote end portion, whereby when said control valve is in the open position, water from the supply line is sprayed from said nozzle directly on the rectal area of a user owing to the position and orientation of said remote end portion.

* * * * *

UNITED STATES PATENT AND TRADEMARK OFFICE

CERTIFICATE OF CORRECTION

PATENT NO. : 5,652,971

DATED : August 5, 1997

INVENTOR(S) : Wokas, Albert L.

It is certified that error appears in the above-indentified patent and that said Letters Patent is hereby corrected as shown below:

In the drawings, Sheet 2, Fig. 2, the arrangement of elbows 40 and 48 should appear as follows:

Signed and Sealed this

Twenty-eighth Day of October, 1997

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,652,971

DATED : August 5, 1997

INVENTOR(S) : Wokas, Albert L.

It is certified that error appears in the above-indentified patent and that said Letters Patent is hereby corrected as shown below:

In the drawings, Sheet 2, Fig. 2, the arrangement of elbows 40 and 48 should appear as follows:

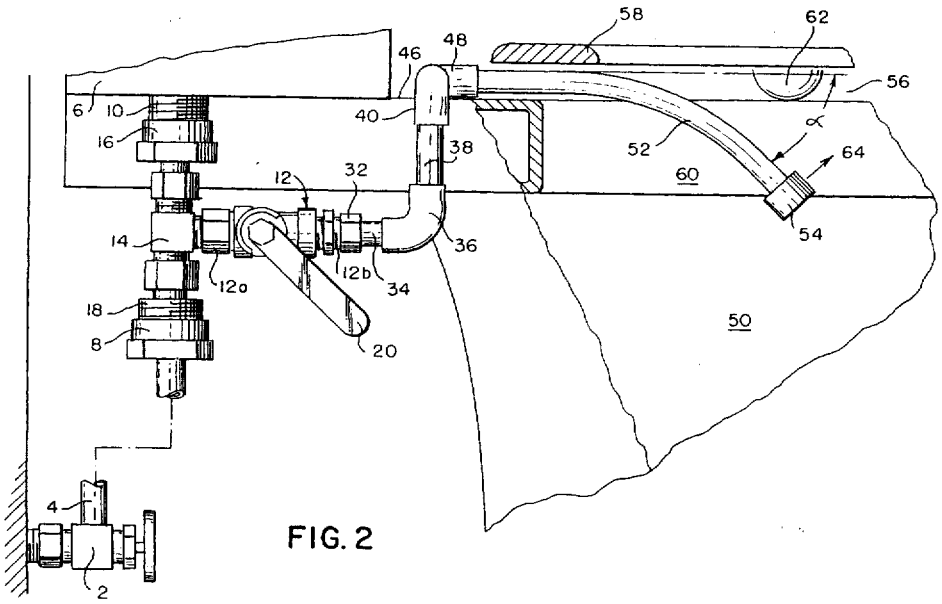

FIG. 2